US006877331B2

(12) United States Patent
Takeuchi et al.

(10) Patent No.: US 6,877,331 B2
(45) Date of Patent: Apr. 12, 2005

(54) AIR CONDITIONER

(75) Inventors: Makio Takeuchi, Sakai (JP); Akihiko Sakashita, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 116 days.

(21) Appl. No.: 10/363,651

(22) PCT Filed: Apr. 3, 2002

(86) PCT No.: PCT/JP02/03359

§ 371 (c)(1),
(2), (4) Date: Mar. 4, 2003

(87) PCT Pub. No.: WO03/008870

PCT Pub. Date: Jan. 30, 2003

(65) Prior Publication Data

US 2004/0093886 A1 May 20, 2004

(30) Foreign Application Priority Data

Jul. 18, 2001 (JP) ..... 2001-217821

(51) Int. Cl.[7] ..... F25D 23/12; F25D 17/06
(52) U.S. Cl. ..... 62/259.1; 62/419; 62/DIG. 16
(58) Field of Search ..... 62/259.1, 419, 62/DIG. 16; 165/122, 53

(56) References Cited

FOREIGN PATENT DOCUMENTS

| | | | |
|---|---|---|---|
| JP | 62-162830 | A | 7/1987 |
| JP | 5-5536 | A | 1/1993 |
| JP | 9-133374 | A | 5/1997 |
| JP | 11-148711 | A | 6/1999 |
| JP | 2000-121089 | A | 4/2000 |
| JP | 2000-220859 | A | 8/2000 |
| JP | 2001-124359 | A | 5/2001 |

*Primary Examiner*—Chen Wen Jiang
(74) *Attorney, Agent, or Firm*—Shinjyu Global IP Counselours, LLP

(57) ABSTRACT

The present invention is an air conditioner that is built into or hung from a ceiling and which employs a cross fin type of heat exchanger, in which the effective length of the heat exchanger is increased without increasing the size of the casing of the indoor unit. An indoor unit has a casing that supports the components of the indoor unit and in which an air suction port and air discharge ports are formed, a centrifugal fan disposed inside the casing for taking in air from the air suction port and discharging air out to the sides thereof, and a cross fin type of heat exchanger for exchanging heat with the air discharged from the centrifugal fan and disposed so that it surrounds the centrifugal fan. The heat exchanger has a plurality of concave portions that are formed such that they are near the outer circumferential portion of the centrifugal fan, and a plurality of convex portions that are formed such that the extend away from the outer circumferential portion of the centrifugal fan.

8 Claims, 5 Drawing Sheets

AIR CONDITIONER

TECHNICAL FIELD

The present invention relates to an air conditioner, and more particularly to an air conditioner either built into or hanging from a ceiling.

BACKGROUND ART

An air conditioner is mainly constructed of an outdoor unit that has a compressor and a heat exchanger, and an indoor unit that has a centrifugal fan and a heat exchanger. The indoor unit can be any one of a variety of types, such as one mounted on a wall, built into a ceiling, hanging from the ceiling or the like.

Indoor units that are built into or hanging from a ceiling are primarily composed of a casing that has an air suction port and a air discharge port on the bottom surface thereof, a centrifugal fan disposed inside the casing, and a heat exchanger disposed such that it surrounds the centrifugal fan. In this type of indoor unit, indoor air is taken into the interior of the casing from the air suction port, and is then blown by the centrifugal fan to the outer circumferential portion thereof. Then, the air blown to the outer circumferential portion of the centrifugal fan exchanges heat with the heat exchanger disposed around the centrifugal fan, and is then supplied to the interior of the room from the air discharge port.

Conventionally, many heat exchangers disposed in the casing of an indoor unit are cross fin type, and are bent into an approximate rectangular or circular shape such that they surround the centrifugal fan in a plane view.

With this type of heat exchanger, it is desirable to increase the effective length of the heat exchanger and to improve the heat exchanging performance of the air conditioner.

The size of the casing of the indoor unit can be made larger in order to increase the effective length of the heat exchanger. However, from a practical point of view, it is not desirable for the size of a conventional casing to be enlarged, and this is the main cause of an increase in costs.

DISCLOSURE OF THE INVENTION

An object of the present invention is to increase the effective length of a cross fin type of heat exchanger employed in an air conditioner that is built into or hung from a ceiling, without increasing the size of the casing of the indoor unit.

The air conditioner disclosed in claim 1 is an air conditioner that is built in or hung from a ceiling and which includes a casing having an air suction port for taking in air into the interior thereof and air discharge ports for discharging air to the exterior thereof, a centrifugal fan disposed in the interior of the casing and between the air suction port and the air discharge ports, and a cross fin type of heat exchanger disposed between the centrifugal fan and the air discharge ports and inside the casing such that it surrounds the centrifugal fan. The heat exchanger has a plurality of convex portions that are formed such that they extend away from an outer circumferential portion of the centrifugal fan, and a plurality of concave portions that are formed such that they are near the outer circumferential portion of the centrifugal fan.

In this air conditioner, indoor air is taken into the interior of the casing from the air suction port by means of the centrifugal fan, and is then blown out to the outer circumference of the centrifugal fan. Then the air blown out from the centrifugal fan exchanges heat with a cross fin type of heat exchanger disposed such that it surrounds the centrifugal fan, and afterward the air is discharged from the air discharge port and supplied to the interior of the room. The cross fin type of heat exchanger installed here has a plurality of convex portions formed such that they extend away from the outer circumferential portion of the centrifugal fan and a plurality of convex portions formed such that they are near the circumferential portion of the centrifugal fan. Because of this, the effective length of the heat exchanger is increased when compared to a heat exchanger installed in an air conditioner having a casing that is of a conventional size. Thus, the effective length of the heat exchanger can be increased without making the size of the casing larger.

The air conditioner disclosed in claim 2 is the air conditioner of claim 1, in which the concave portions are disposed in positions opposite at least the air discharge ports.

In this air conditioner, the heat exchanger is not too close to the air discharge ports, and the air discharge ports are not narrowed, because the concave portions of the beat exchanger are provided in positions opposite at least the air discharge ports. In other words, the surface area of the openings of air discharge ports are maintained, the ability to blow air out therefrom is not worsened, and the effective length of the heat exchanger can be increased.

The air conditioner disclosed in claim 3 is the air conditioner of claim 1 or 2, in which the casing is approximately rectangular in shape, the plurality of air discharge ports are disposed in positions opposite each side of the casing, and the plurality of convex portions are disposed in positions that are opposite at least the corners of the casing.

In this air conditioner, the space in the casing can be effectively used because the convex portions of the heat exchanger are provided in positions opposite the corners which have a comparatively large space.

The air conditioner disclosed in claim 4 is the air conditioner of claim 2 or 3, in which the heat exchanger further includes sloped portions that extend from one corner of the casing to an adjacent corner and are inclined with respect to the sides of the casing.

In this air conditioner, the heat exchanger has sloped portions that extend such that they are inclined with respect to the sides of the casing. On the other hand, a conventional heat exchanger that is disposed in an air conditioner having a conventional size casing extends parallel with respect to the sides of the casing. In other words, the effective length of the heat exchanger of the present invention is greater than a conventional beat exchanger. Thus, the effective length of the heat exchanger can be increased without increasing the size of the casing.

The air conditioner disclosed in claim 5 is the air conditioner of claim 3 or 4, in which a drain pump for discharging drain water generated by the heat exchanger to the exterior of the casing is disposed in a position between the heat exchanger inside the casing and one corner of the casing.

In this air conditioner, the space in the casing can be effectively used because the drain pump is provided in a corner of the casing having a comparatively large space.

The air conditioner disclosed in claim 6 is the air conditioner of claim 5, in which the heat exchanger further includes a bent portion that extends along the drain pump in a position opposite the corner in which the drain pump is disposed.

In this air conditioner, the effective length of the heat exchanger can be increased when compared to the shape of a conventional heat exchanger bent along the outer circumferential portion of a centrifugal fan in the corners of the casing of the air conditioner, because the shape of the heat exchanger is bent in the corner of the casing in which the drain pump is disposed and along the drain pump.

The air conditioner disclosed in claim 7 is the air conditioner in any of claim 1 to 6, in which the heat exchanger is a cross fin type of heat exchange unit that is bent.

In this air conditioner, the heat exchanger is constructed from one cross fin type of heat exchange unit. In other words, the heat exchanger is not constructed from a plurality of heat exchange units, but rather is one cross fin type of heat exchange unit in which a plurality of concave portions and a plurality of convex portions have been formed therein. Thus, it is not necessary to branch the refrigerant lines of the heat exchanger, and the structure thereof can be simplified.

The air conditioner disclosed in claim 8 is the air conditioner of any of claim 1 to 7, in which an electric component box that stores electric components is disposed in a position between a convex portion of the heat exchanger and the outer circumferential portion of the centrifugal fan.

In this air conditioner, the space between the convex portion of the beat exchanger and the outer circumferential portion of the centrifugal fan is bigger than other portions. Thus, the electrical components needed to operate the air conditioner can be assembled in the electrical component box, stored therein, and disposed in this space.

BEST MODE FOR CARRYING OUT THE INVENTION

First Embodiment (1) Structure of the Air Conditioner

Figure 1:
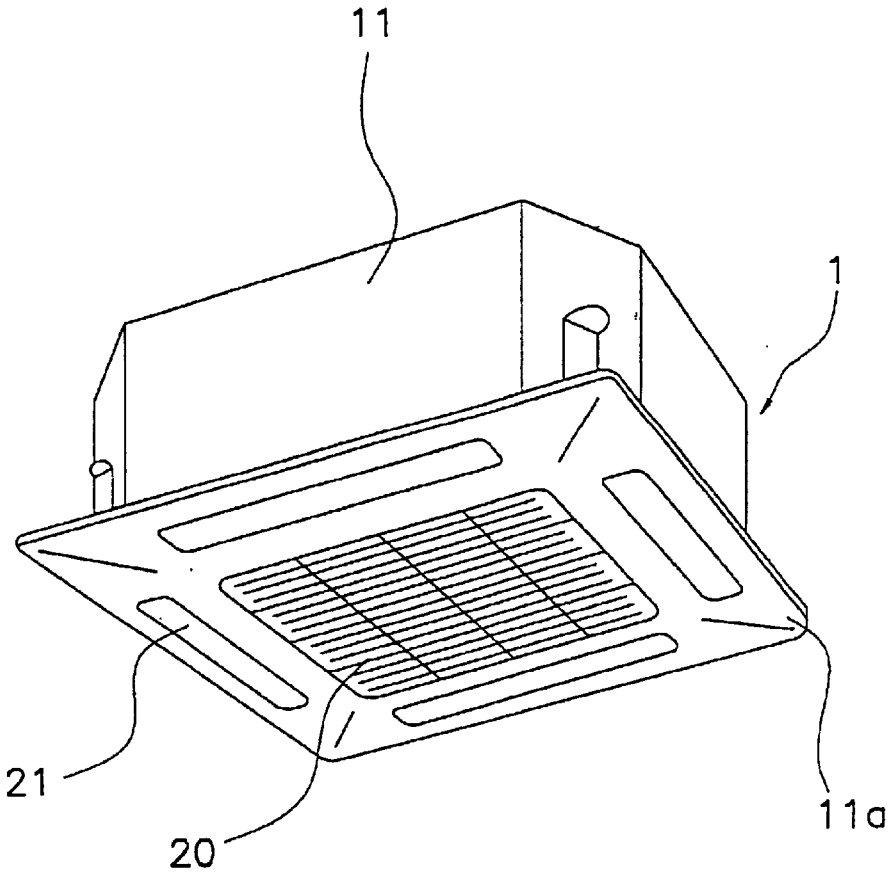
FIG. 1 is an outer perspective view of an indoor unit of an air conditioner according to a first embodiment of the present invention.

An outer perspective view (ceiling omitted) of an indoor unit 1 of an air conditioner according to a first embodiment of the present invention is shown in FIG. 1. The indoor unit 1 is a type that is built into a ceiling, and has a casing 11 that is built into the ceiling. The indoor unit 1 is installed indoors, and takes in indoor air from an air intake 20 into the interior of the casing 11. After conditioning the air by heat exchange, the air is discharged from the casing 11 through an air discharge port 21 and supplied to the indoor space.

Next, a description of the casing 11 will be provided.

The casing 11 is a member for supporting the components of the indoor unit 1 therein. The casing 11 has a substantially rectangular solid shaped exterior, and a substantially rectangular shaped decoration panel 11*a* on the bottom thereof. An air suction port 20 is formed in the middle of the bottom portion of the casing 11, and four rectangular air discharge ports 21 are formed around the outer circumference of the air suction port 20 such that they are opposite each side thereof.

Figure 2:
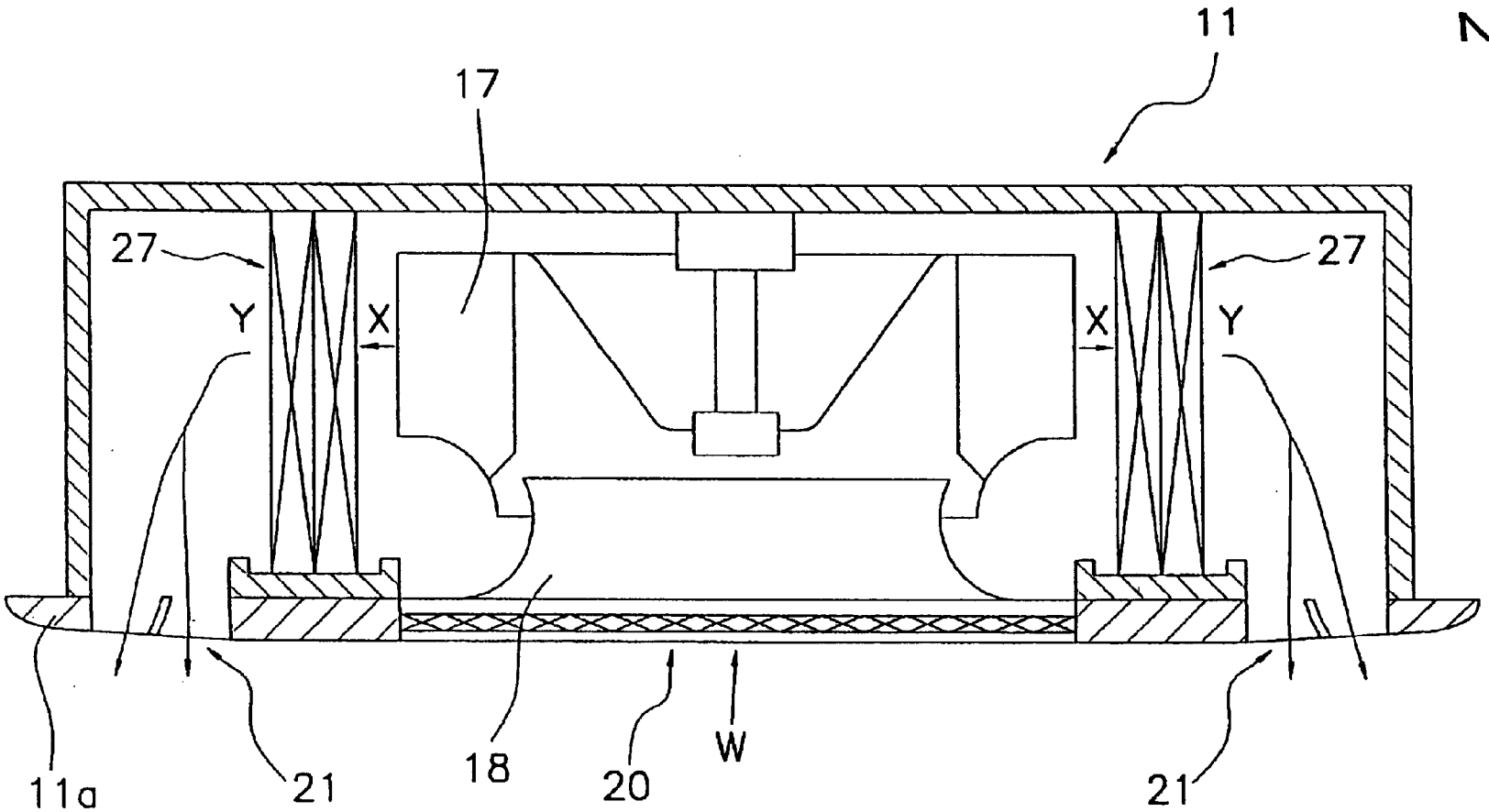
FIG. 2 is a lateral cross-sectional view of the indoor unit of the air conditioner according to the first embodiment of the present invention.
Figure 3:
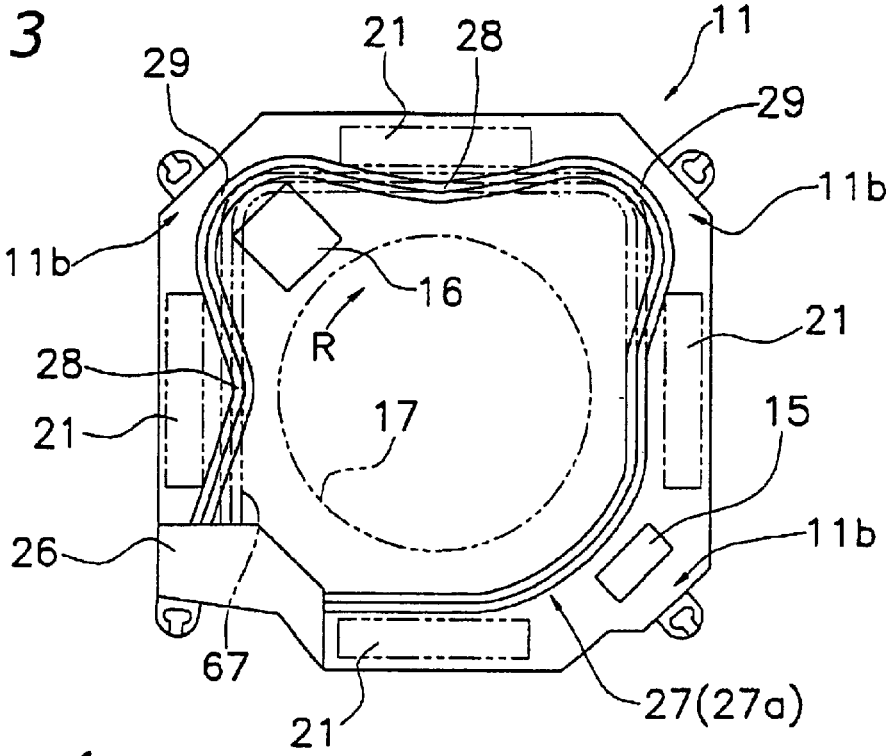
FIG. 3 is a bottom view showing the interior of the indoor unit of the air conditioner according to the first embodiment of the present invention (a conventional example of a heat exchanger is also shown).

FIG. 2 is a lateral cross sectional view of the indoor unit 1, and FIG. 3 is a bottom view showing the interior of the indoor unit 1. A bell mouth 18 is disposed in the interior of the casing 11 which faces the air suction port 20, and a centrifugal fan 17 for taking air in from the air suction port 20 and discharging air on the sides thereof is disposed above the bell mouth 18. A cross fin type heat exchanger 27 for exchanging heat with the air discharged from the centrifugal fan 17 is disposed between the centrifugal fan 17 and the air discharge port 21 such that it surrounds the centrifugal fan 17.

Next, a description of the heat exchanger 27 will be provided.

As shown in FIG. 3, the heat exchanger 27 is a member in which one cross fin type heat exchange unit 27a has been bent, and includes two concave portions 28 that are formed so that they are near the outer circumference of the centrifugal fan 17, and two convex portions 29 that are formed so that they extend away from the outer circumference of the centrifugal fan 17, all of which extend along the direction of rotation of the centrifugal fan 17 (hereinafter referred to as the rotational direction R). The heat exchanger 27 is connected to a outdoor unit refrigerant line (not shown in the figures) by a refrigerant line connector 26.

Here, the two concave portions 28 are disposed in positions that face two of the air discharge ports 21, and are disposed such that they do not obstruct the air discharge ports 21 in the plane view of the casing 11. In addition, each convex portion 29 is disposed between two of the air discharge ports 21, i.e., disposed such that they project out to near the wall surfaces of the rectangular corner portions 11*b* of the casing 11.

An electric component box 16 which stores the electric components needed for operating the indoor unit 1 (air conditioner) is disposed in a space formed by one of the convex portions 29 of the heat exchanger 27 (in the present embodiment, the direction of rotation R side of the refrigerant line connector 26 in FIG. 3) and the outer circumference of the centrifugal fan 17.

In addition, a convex portion 29 is not formed in one of the rectangular corner portions 11*b* of the casing 11 (in the present embodiment, the opposite side of the direction of rotation R of the refrigerant line connector 26 in FIG. 3), but rather has a drain pump 15 for discharging condensed water that is produced during heat exchange.

(2) Operation of the Air Conditioner

As shown by the arrow W in FIG. 2, when the centrifugal fan 17 is rotated, indoor air is drawn into the interior of the indoor unit 1 from the air suction port 20. The air drawn therein, as shown by the arrow X in FIG. 2, is discharged to the outer circumferential portion of the centrifugal fan 17. The air discharged to the outer circumferential portion of the centrifugal fan 17, as shown by the arrow Y in FIG. 2, exchanges heat with the heat exchanger 27 disposed on the outer circumferential side of the centrifugal fan 17, and is discharged to the interior of the room from the air discharge ports 21 provided in the bottom portion of the casing 11.

(3) Special Characteristics of the Air Conditioner

Figure 6:
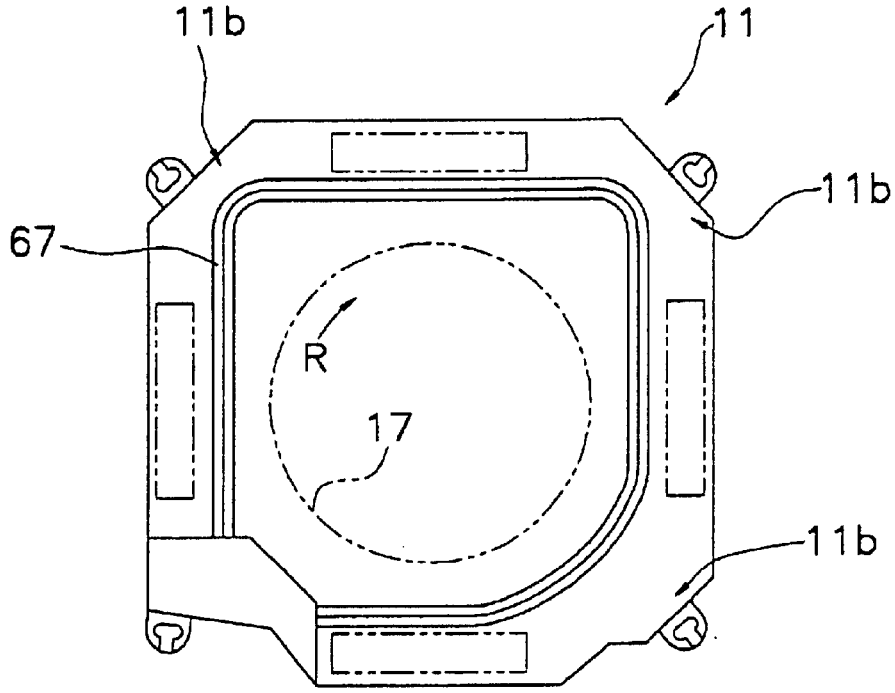
FIG. 6 is a bottom view showing the interior of an indoor unit of a conventional example of an air conditioner.

As described above, the special characteristics of the air conditioner of the present embodiment are as follows:

a. Increase in the effective length of the heat exchanger by means of the concave and convex portions FIG. 6 is a bottom view of the interior of a conventional example of an indoor unit 1. A conventional heat exchanger 67 is bent into an approximate rectangular shape along the corner portions 11*b* of a rectangular shaped casing 11.

On the other hand, the present embodiment shown in FIG. 3 has a plurality of convex portions 29 that are formed so that they extend away from the outer circumference of the centrifugal fan 17, and a plurality of concave portions 28 that are formed so that they are near the outer circumference of the centrifugal fan 17. In order to compare the effective length of the heat exchanger of the first embodiment with the effective length of the conventional heat exchanger, FIG. 3 shows a bottom view of the conventional example of the heat exchanger 67 superimposed over a bottom view of the heat exchanger 27 of the first embodiment in an indoor unit 1 having the same casing size. As can be seen from this figure, compared to the conventional example of the heat exchanger 67, the concave portions 28 of the heat exchanger 27 of the first embodiment are disposed such that they are near the centrifugal fan 17 and the convex portions 29 of the heat exchanger 27 of the first embodiment are disposed such that they extend away from the centrifugal fan 17. Thus, the effective length of the heat exchanger 27 of the present embodiment is longer even though the size of the casing 11 of the indoor unit is the same as that used conventionally.

In addition, because the plurality of concave portions 28 are disposed in positions facing two of the air discharge ports 21, the surface areas of the openings of the two air discharge ports 21 are maintained while increasing the effective length of the heat exchanger 27.

Moreover, because the concave portions 28 and the convex portions 29 are not separate structures that make up a plurality of heat exchanging units, and are instead part of one cross fin type heat exchanger 27a that has been bend into shape, it is not necessary to branch the refrigerant line from the refrigerant line connector 26 to the heat exchanger 27, and the structure is thereby simplified.

b. Increase in the space inside the casing by means of the concave and convex portions In the present embodiment, because the concave portions 28 of the heat exchanger 27 are disposed in positions facing the air discharge ports 21 and the convex portions 29 are disposed in the corners of the casing 11, the space between the convex portions 29 and the outer circumference of the centrifugal fan 17 is larger than other parts of the casing 11. Thus, the electrical components needed to operate the air conditioner can be stored in the electrical component box 16.

Second Embodiment

Figure 4:
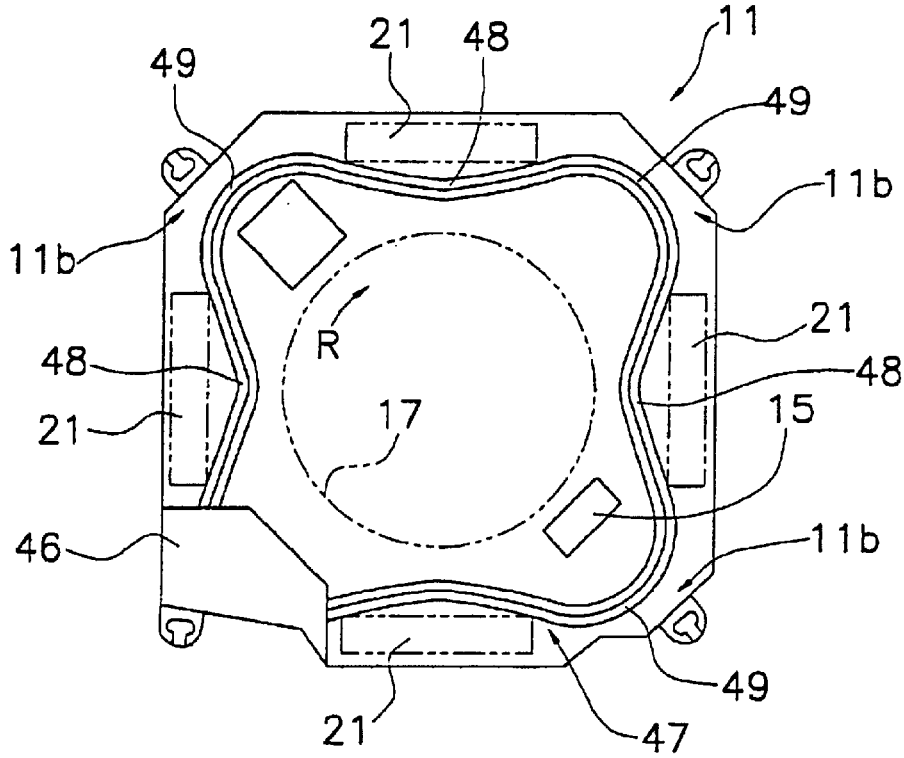
FIG. 4 is a bottom view showing the interior of an indoor unit of an air conditioner according to a second embodiment of the present invention.

In the aforementioned embodiment, the concave portions 28 and the convex portions 29 are formed opposite two sides of the rectangular casing 11 but may be formed on the other two sides of the casing 11. FIG. 4 shows a heat exchanger 47 in which the concave portions 48 and the convex portions 49 have been formed opposite each side of the rectangular casing 11. In the present embodiment, the drain pump 15 is disposed in a space formed by one of the convex portions 49 of the heat exchanger 47 (in the present embodiment, on the opposite side of the direction of rotation R of the refrigerant line connector 46 in FIG. 4) and the outer circumferential portion of the centrifugal fan 17.

In the present embodiment, the effective length of the heat exchanger can be extended even further.

Third Embodiment

Figure 5:
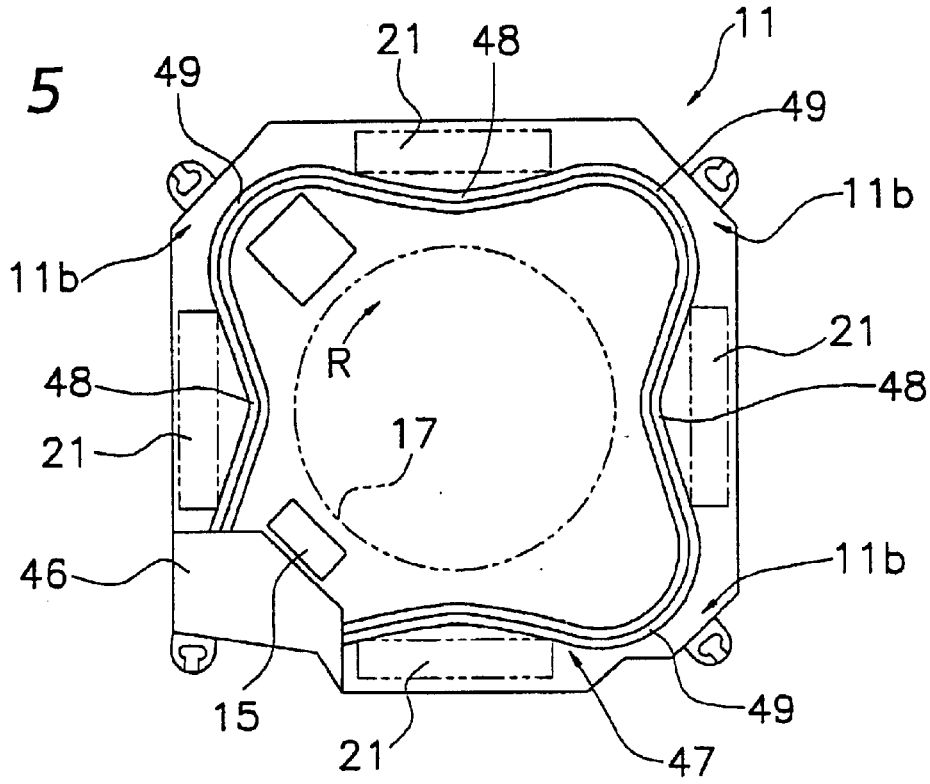
FIG. 5 is a bottom view showing the interior of an indoor unit of an air conditioner according to a third embodiment of the present invention.

In the second embodiment, the drain pump 15 is disposed in the space formed by the convex portion 49 adjacent to the refrigerant line connector 46 and the outer circumferential portion of the centrifugal fan 17. However, as shown in FIG. 5, in the present embodiment the drain pump 15 is disposed in a space between the refrigerant line connector 46 and the outer circumferential portion of the centrifugal fan 17.

In the present embodiment, line construction during the installation of the indoor unit will be simplified because the water drain line for discharging water from the drain pump 15 can be disposed in the same location as the refrigerant line.

Fourth Embodiment

Figure 7:
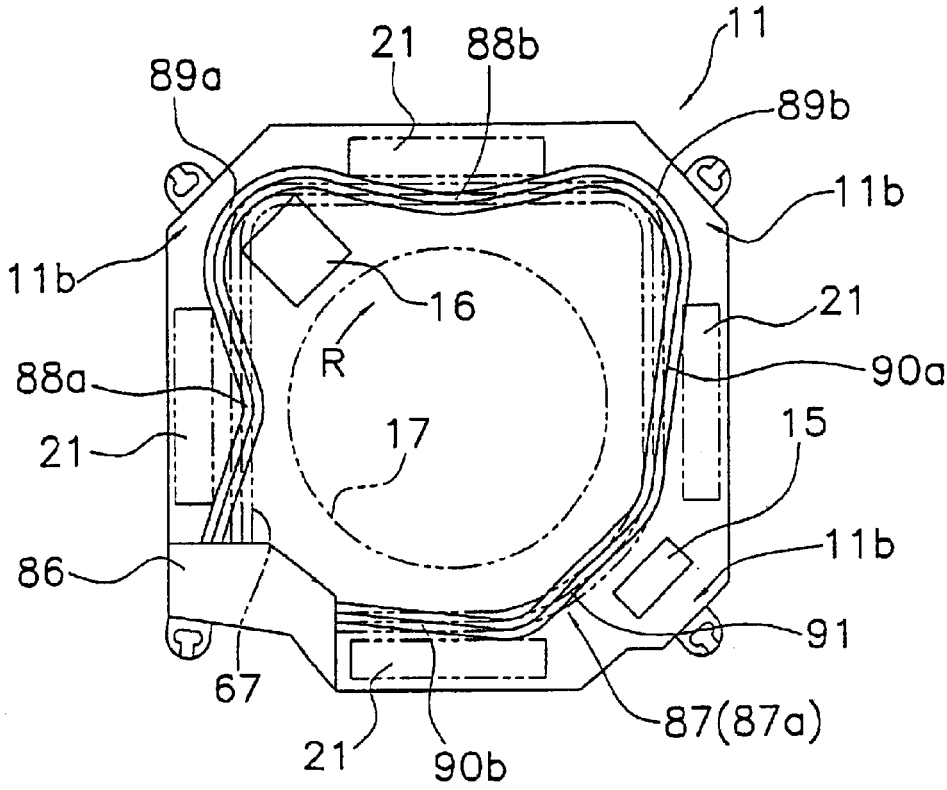
FIG. 7 is a bottom view showing the interior of an indoor unit of an air conditioner according to a fourth embodiment of the present invention (a conventional example of a heat exchanger is also shown).

In the first embodiment, the concave portions 28 and the convex portions 29 are formed opposite two sides of the rectangular casing 11 but two straight sloped portions 90*a*, 90*b* that are inclined away from the sides of the casing 11 may be formed on the other two sides thereof FIG. 7 shows a heat exchanger 87. Like the heat exchanger 27 of the first embodiment, the heat exchanger 87 is one cross fin type of heat exchanging unit 87*a* that has been bent into shape, and includes a first concave portion 88*a* that is formed such that it is opposite the side of the casing 11 adjacent to a refrigerant line connector 86 and near the outer circumferential portion of the centrifugal fan 17, a first convex portion 89a that is formed such that it is opposite the corner 11*b* of the casing 11 adjacent to the first concave portion 88*a* and extends away from the outer circumferential portion of the centrifugal fan 17, a second concave portion 88*b* that is formed such that it is opposite the side of the casing 11 adjacent to the first convex portion 89*a* and near the outer circumferential portion of the centrifugal fan 17, a second convex portion 88*b* that is formed such that it is opposite the corner 11*b* of the casing 1 1 adjacent to the second concave portion 88*b* and extends away from the outer circumferential portion of the centrifugal fan 17, a straight first sloped portion 90*a* that extends such that it is inclined with respect to the side of the casing 11 adjacent to the second convex portion 88*b*, and a straight second sloped portion 90*b* that extends such that it is inclined with respect to the side of the casing 11 adjacent to the first sloped portion 90*a*. A bent portion 91 is formed opposite the corner 11*b* of the casing 11 that is between the first sloped portion 90*a* and the second sloped portion 90*b*. A drain pump 15 is disposed between the bent portion 91 and the corner 11*b* in which the bend portion 91 was provided. The bend portion 91 has a straight shape that is bent such that it extends along the side of drain pump 15.

Because the sloped portions 90*a*, 90*b* extend such that they are inclined with respect to the sides of the casing 11, they increase the effective length of the heat exchanger 67 when compared to situations in which they extend parallel to the sides of the casing 11 like that of the conventional heat exchanger 67. In addition, because the bent portion 91 extends along the side of the drain pump 15, it increases the effective length of the heat exchanger when compared to situations in which it is bent along the outer circumference of the centrifugal fin like the conventional heat exchanger 67.

In the present embodiment, like with the heat exchanger 27 of the first embodiment, the effective length of the heat exchanger 87 can be increased when compared with the conventional heat exchanger 67 because it has concave portions 89*a*, 89*b*, and convex portions 88*a*, 88*b*. In addition, the effective length of the heat exchanger 87 can be increased when compared to the heat exchanger 27 of the first embodiment because it has two sloped portions 90*a*, 90*b* and a bent portion 91.

Other Embodiments

In the aforementioned embodiments, the present invention is applied to an air conditioner that is built into a ceiling. However, the present invention can also be applied to an air conditioner that is hung from the ceiling.

Industrial Applicability

According to the present invention, the effective length of a heat exchanger can be increased without enlarging the size of the casing.

What is claimed is:

1. An air conditioner built into or hung from a ceiling comprising:

a casing having an air suction port for taking in air into the interior thereof and air discharge ports for discharging air to the exterior thereof;

a centrifugal fan disposed in the interior of the casing and between the air suction port and the air discharge ports; and a cross fin type of heat exchanger disposed between the centrifugal fan and the air discharge ports and inside the casing so that it surrounds the centrifugal fan, the heat exchanger having a plurality of convex portions that are formed such that they extend away from an outer circumferential portion of the centrifugal fan, and a plurality of concare portions that are formed such that they are near the outer circumferential portion of the centrifugal fan.

2. The air conditioner according to claim 1, wherein the concave portions are disposed in positions opposite at least the air discharge ports.

3. The air conditioner according to claim 1, wherein the casing is approximately rectangular in shape with corners;

the air discharge ports are disposed in positions opposite each side of the casing; and the plurality of convex portions are disposed in positions that are opposite at least one of the corners of the casing.

4. The air conditioner according to claim 3, wherein the heat exchanger further includes sloped portions that extend from one of the corners of the casing to an adjacent one of the corners and are inclined with respect to the sides of the casing.

5. The air conditioner according to claim 3, wherein a drain pump for discharging drain water generated by the heat exchanger to the exterior of the casing is disposed in a position between the heat exchanger inside the casing and one corner of the casing.

6. The air conditioner according to claim 5, wherein the heat exchanger further includes a bent portion that extends along the drain pump in a position opposite the corner in which the drain pump is disposed.

7. The air conditioner according to claim 1, wherein the heat exchanger is a cross fin type of heat exchange unit that is bent.

8. The air conditioner according to claim 1, further comprising an electric component box that stores electric components is disposed in a position between the convex portions of the heat exchanger and the outer circumferential portion of the centrifugal fan.

* * * * *

UNITED STATES PATENT AND TRADEMARK OFFICE

CERTIFICATE OF CORRECTION

PATENT NO. : 6,877,331 B2
DATED : April 12, 2005
INVENTOR(S) : Makio Takeuchi et al.

It is certified that error appears in the above-identified patent and that said Letters Patent is hereby corrected as shown below:

Column 8,
Line 21, “one corner” should read -- one of the corners --.
Lines 24-25, “the corner” should read -- one of the corners --.

Signed and Sealed this

Nineteenth Day of July, 2005

JON W. DUDAS
*Director of the United States Patent and Trademark Office*